United States Patent [19]

Peters

[11] Patent Number: 4,966,218

[45] **Date of Patent: * Oct. 30, 1990**

[54] WINDOW CORNICE AND METHOD FOR HANGING CURTAINS

[76] Inventor: Margaret A. Peters, 1139 Summit Lawn, Wichita, Kans. 67212

[ * ] Notice: The portion of the term of this patent subsequent to Sep. 12, 2006 has been disclaimed.

[21] Appl. No.: 428,640

[22] Filed: Oct. 30, 1989

Related U.S. Application Data

[63] Continuation of Ser. No. 173,056, Mar. 25, 1988, Pat. No. 4,865,105.

[51] Int. Cl.[5] ..... E04F 10/00

[52] U.S. Cl. ..... 160/38; 160/387; 29/433

[58] Field of Search ..... 160/38, 387, 39, 19, 160/383; 29/433

[56] References Cited

U.S. PATENT DOCUMENTS

| | | | |
|---|---|---|---|
| D. 114,564 | 5/1939 | Stratton . | |
| 1,154,775 | 9/1915 | Johnson | 150/32 |
| 1,465,821 | 8/1923 | Henderson | 160/20 |
| 1,565,734 | 12/1925 | Greenhut | 160/19 X |
| 1,636,601 | 7/1927 | Givens | 160/25 |
| 1,773,590 | 8/1930 | Mathias | 160/19 |
| 1,914,027 | 6/1933 | Kress | 160/19 |
| 1,963,404 | 6/1934 | Dixson | 160/31 |
| 1,974,645 | 9/1934 | Dixson | 160/31 |
| 2,138,564 | 10/1938 | Barrow | 160/31 |
| 2,243,222 | 5/1941 | Rebholz | 156/13 |
| 2,250,003 | 7/1941 | Boye | 160/21 |
| 2,293,662 | 8/1942 | Richardson | 156/13 |
| 2,315,033 | 3/1943 | Adair | 160/39 |
| 2,363,847 | 11/1944 | Dudas | 160/387 |
| 2,533,216 | 12/1950 | Bixer | 160/387 |
| 2,563,734 | 8/1951 | Metz et al. | 160/39 X |
| 2,604,155 | 7/1952 | Junkunc | 160/38 |
| 2,616,495 | 11/1952 | Junkunc | 160/38 |
| 2,651,357 | 9/1953 | Skwark | 160/34 |
| 2,681,697 | 6/1954 | Mandella | 160/19 |
| 2,739,644 | 3/1956 | Brand | 160/39 |
| 2,823,743 | 2/1958 | Isaac | 160/39 |
| 2,837,150 | 6/1958 | Toti | 160/38 |
| 2,862,549 | 12/1958 | Robbins | 160/38 |
| 2,998,062 | 8/1961 | Bixby | 160/39 |
| 3,023,909 | 3/1962 | Martens | 160/39 X |
| 3,111,162 | 11/1963 | Bierlich | 160/38 X |
| 3,166,286 | 1/1965 | Pfaff | 248/263 |
| 3,378,057 | 4/1968 | Synck | 160/39 |
| 3,513,902 | 5/1970 | Merillet | 29/433 X |
| 3,913,204 | 10/1975 | Finkbeiner | 29/433 X |

FOREIGN PATENT DOCUMENTS

| | | | |
|---|---|---|---|
| 85641 | 6/1958 | Denmark | 160/39 |
| 342061 | 10/1921 | Fed. Rep. of Germany | 160/19 |
| 512168 | 10/1929 | Fed. Rep. of Germany | 34/3 |
| 910439 | 6/1946 | France | 160/38 |
| 1255291 | 1/1961 | France | 160/19 |
| 1529593 | 5/1968 | France | 160/39 |
| 2397177 | 3/1979 | France | 160/39 |
| 163818 | 7/1958 | Sweden . | |

OTHER PUBLICATIONS

Sears, Roebuck and Co. Catalog TM 1981, Diane Von Furstenberg.

(Prior Art) Plumberg, Pipe with Pipe Elbows Secured at Ends with Plumbing Pipe Secured to Wall with Brackets and Fabric Pulled Over Pipe & Elbows.

*Primary Examiner*—Blair M. Johnson

*Attorney, Agent, or Firm*—John W. Carpenter

[57] ABSTRACT

A window cornice assembly having a semi-circular front plate formed with an upper edge having an upper channel and a lower edge having a lower channel. A lower curtain rod is slidably disposed through the lower channel and an upper curtain rod is slidably disposed through the upper channel. A method for hanging curtains by sliding a fabric over the window cornice assembly, mounting the upper and lower curtain rods to a wall, and securing a middle curtain rod to the wall in between the upper and lower curtain rods. A curtain is hung from the middle curtain rods.

59 Claims, 4 Drawing Sheets

FIG. 1
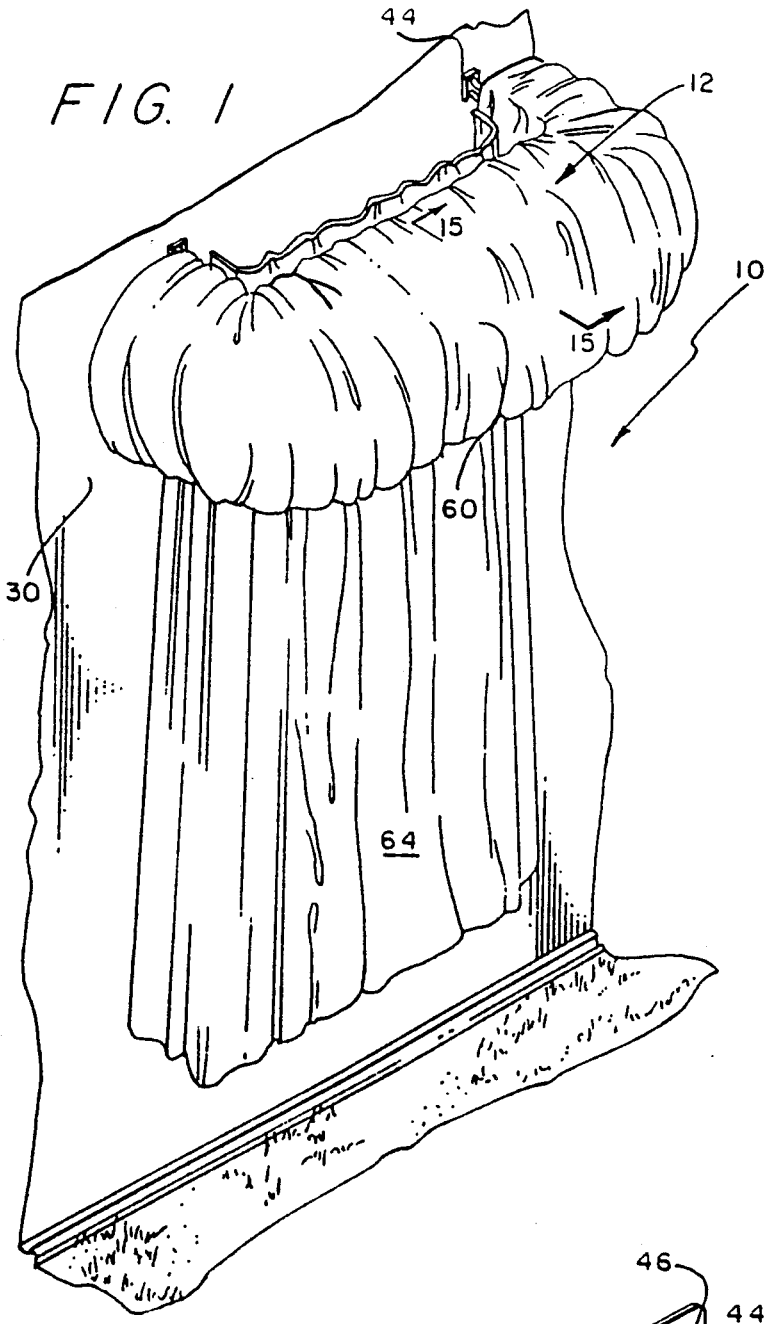
FIG. 2
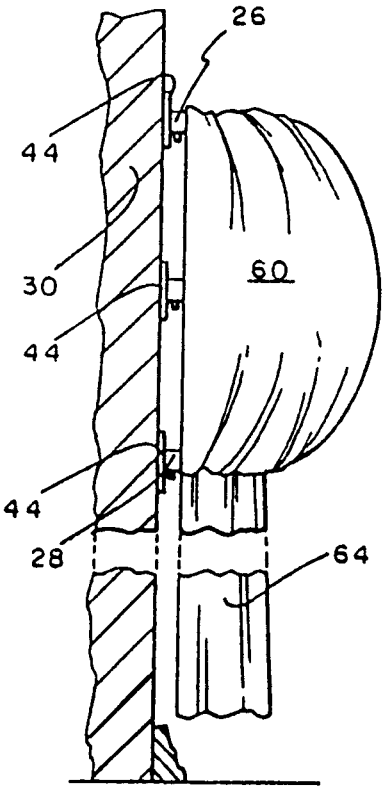
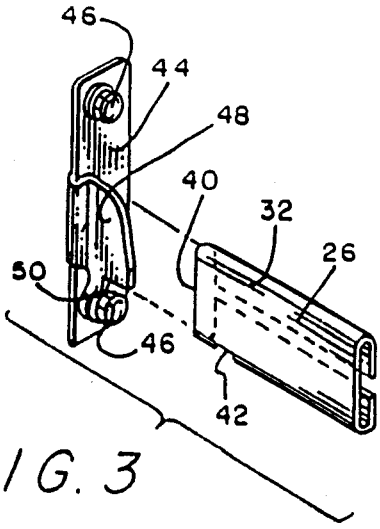
FIG. 3

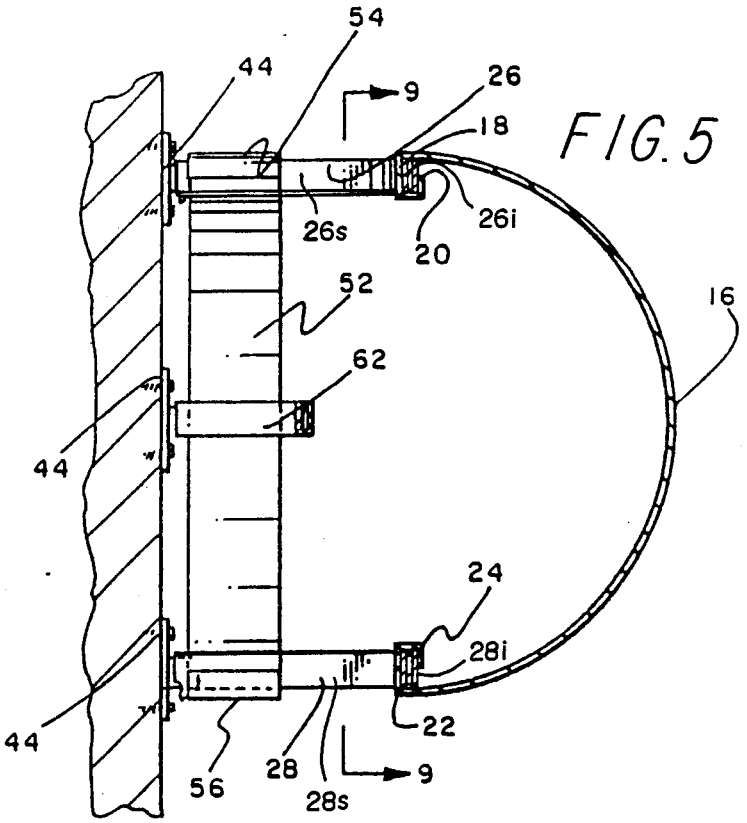
FIG. 5
FIG. 6
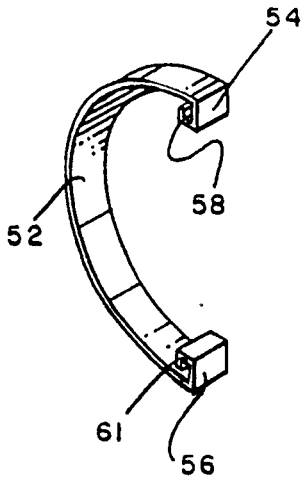
FIG. 4
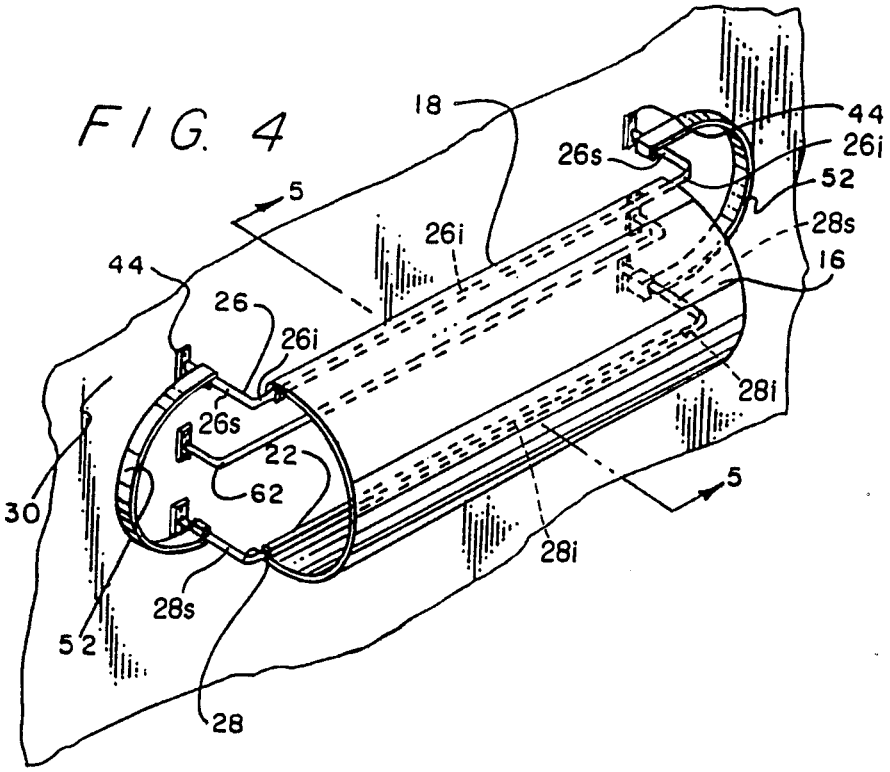

FIG. 7
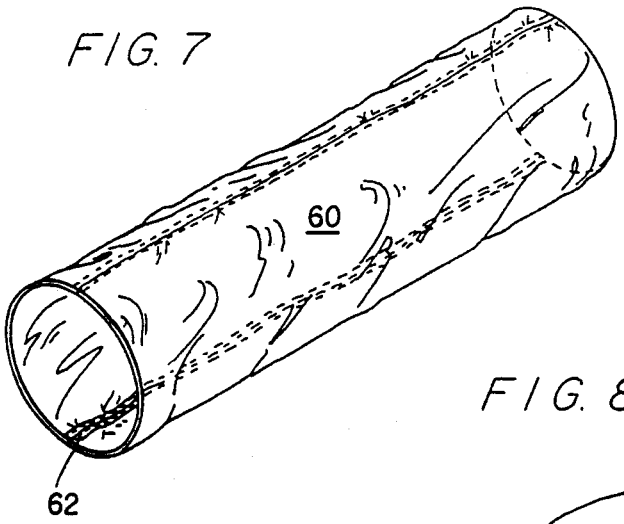
FIG. 8
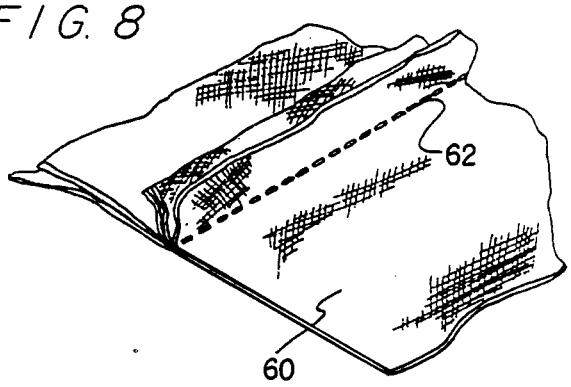
FIG. 9
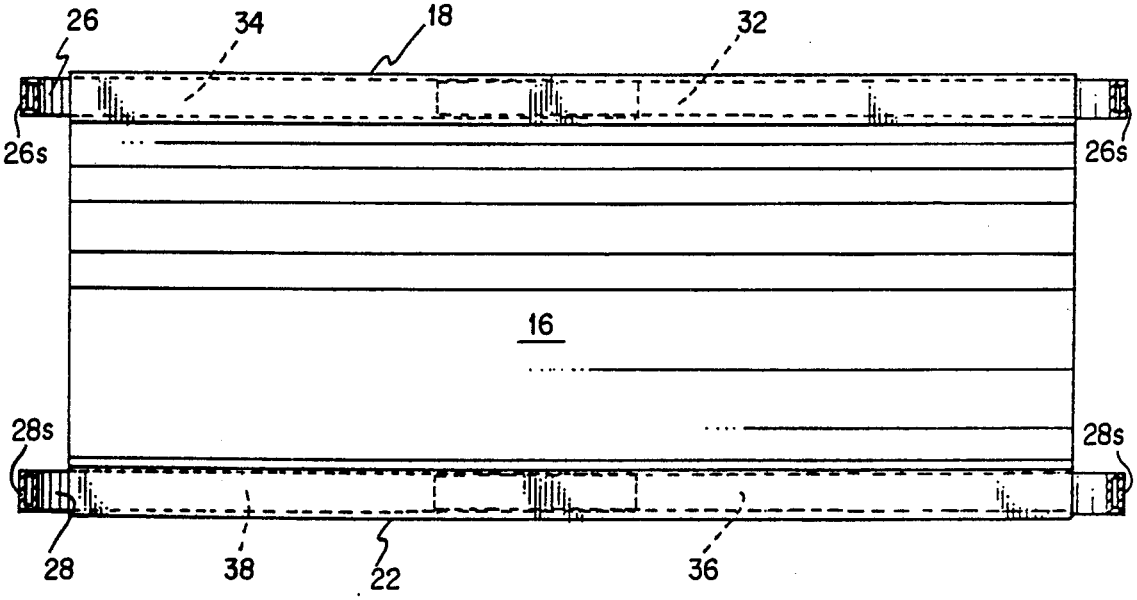
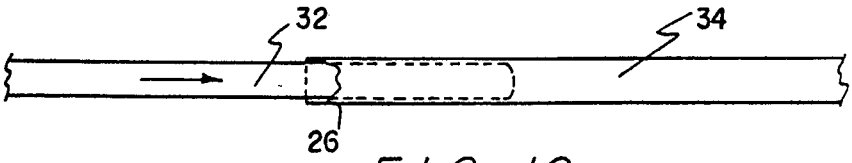
FIG. 10

FIG. 14
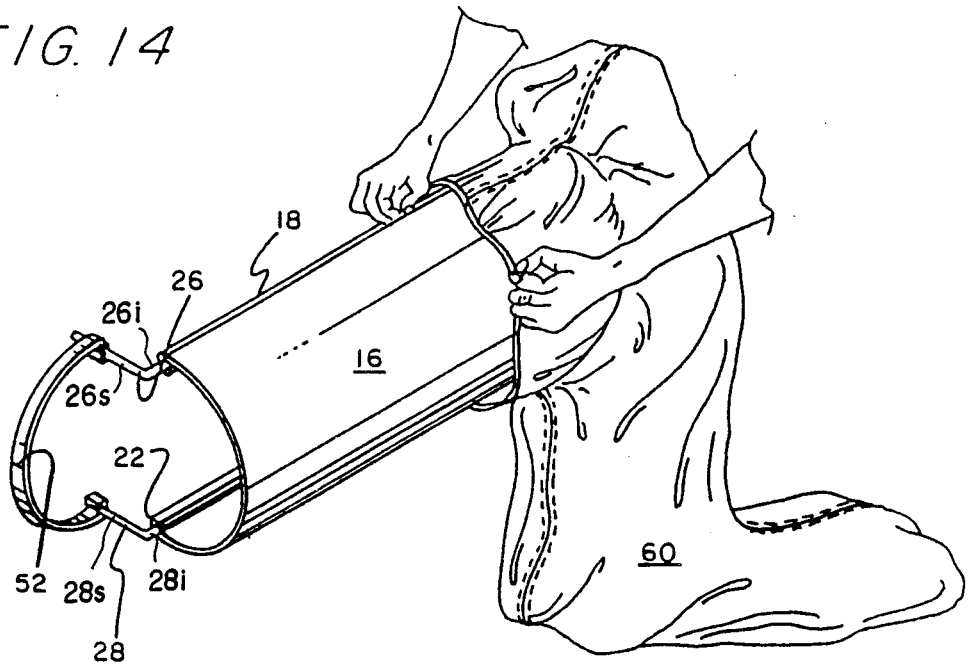
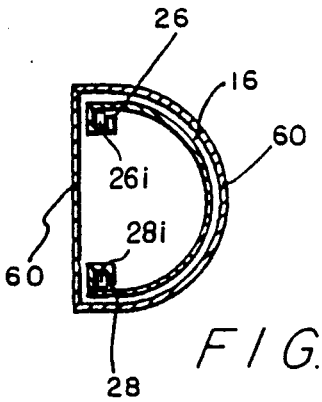
FIG. 15
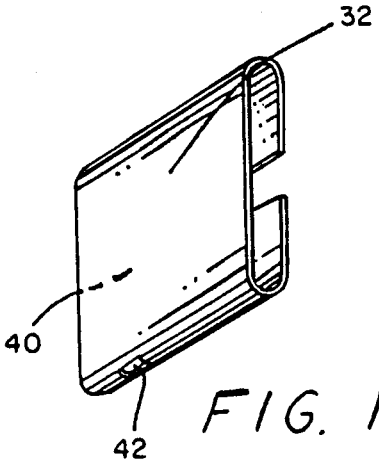
FIG. 13
FIG. 11
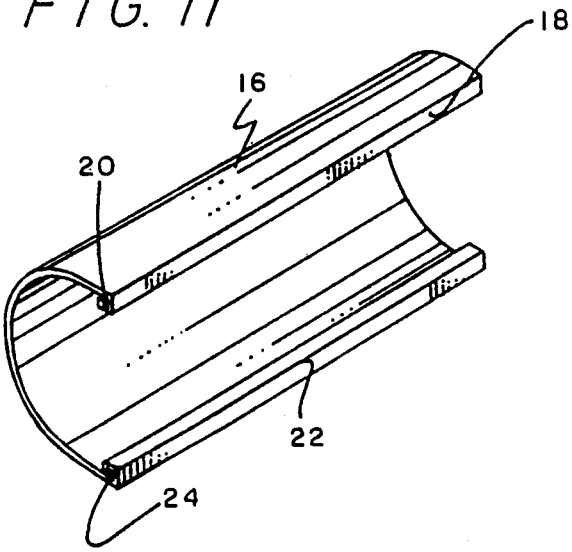
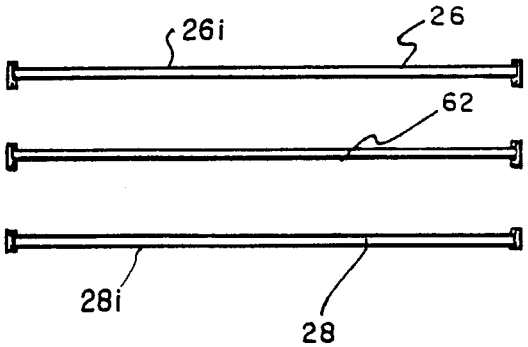
FIG. 12

WINDOW CORNICE AND METHOD FOR HANGING CURTAINS

This is a continuation application of copending patent application having application No. 07/173,056 filed Mar. 25, 1988. Now Pat. No. 486.5105

FIELD OF THE INVENTION

The present invention is related generally to window cornices and the like. More particularly, the present invention relates to improvements in window cornices and to a method for hanging curtains that employs the improved window cornice of this invention.

DESCRIPTION OF THE PRIOR ART

A patentability investigation was conducted and the following United States patents were discovered: Des. 114,564 to Stratton; No. 2,739,644 to Brand; No. 2,823,743 to Isaac; No. 2,998,062 to Bixby; and No. 3,166,286 to Pfaff. None of these prior art patents teach or suggest the particular window cornice and method of this invention.

SUMMARY OF THE INVENTION

The present invention broadly accomplishes its desired objects by broadly providing a window cornice assembly that comprises a front plate member semi-circular in vertical cross-section and having an upper edge and a lower edge. A rod is secured to the semi-circular front plate, preferably to the upper edge thereof or to the lower edge thereof. The rod comprises an intermediate rod section having a first off-set side and a second off-set side bound thereto, with the first off-set side and the second off-set side including ends being adaptable to mount to a wall member. The semi-circular front plate more particularly secures slidably to the intermediate rod section of the rod such that the intermediate rod section extends longitudinally along the length of the semi-circular front plate to longitudinally traverse the front plate. A semi-circular first side plate member is secured to and against the first off-set side, and a semi-circular second side plate member is secured to and against the second off-set side. Preferably, a fabric member is disposed over the front plate member and is supported thereby. Preferably further, the fabric member is additionally disposed over the semi-circular first side plate member, and the semi-circular second side plate member.

The present invention further accomplishes its desired objects by providing a method for hanging curtains and the like comprising the steps of:

(a) forming a generally semi-circular front plate having an upper edge defining an upper channel and a lower edge defining a lower channel;

(b) forming a generally semi-circular first side plate member having a first upper edge defining a first upper channel and a first lower edge defining a first lower channel;

(c) forming a generally semi-circular second side plate member having a second upper edge defining a second upper channel and a second lower edge defining a second lower channel;

(d) sliding a first section of a first curtain rod means through the first upper channel of the semi-circular first side plate and into the upper channel of the semi-circular front plate;

(e) sliding a second section of the first curtain rod means through the second upper channel of the semi-circular second side plate and into the upper channel of the semi-circular front plate;

(f) continuing to slide the first section and the second section of the first curtain rod means while in the upper channel of the semi-circular front plate until the first section slides into the second section such that the first section is slidably disposed within said second section;

(g) sliding a first section of a second curtain rod means through the first lower channel of the semi-circular first side plate and into the lower channel of the semi-circular front plate;

(h) sliding a second section of the second curtain rod means through the second lower channel of the semi-circular second side plate and into the lower channel of the semi-circular front plate;

(i) continuing to slide the first section and the second section of the second curtain rod means while in the lower channel of the semi-circular front plate until the first section of said curtain rod means slides into the second section of said second curtain rod means such that the first section is slidably disposed within said second section;

(j) forming a fabric means into a cylindrical hollow shape;

(k) sliding the formed cylindrical hollow fabric means of step (j) over the first side plate, the front plate and the second side plate such as to entirely surround the semi-circular plate, the first semi-circular side plate and the second semi-circular side plate including the sections of the upper and lower curtain rod means that are slidably disposed in said upper and lower channels respectively of said front plate and in said first upper channel and said first lower channel respectively of said first side plate and in said second upper channel and said second lower channel respectively of said second side plate; and (l) mounting the first and second curtain rod means to a wall member.

It is therefore an object of the present invention to provide a window cornice.

It is another object of the present invention to provide a method for hanging curtains which employs the use of the window cornice.

These, together with the various ancillary objects and features which will become apparent to those skilled in the art as the following description proceeds, are attained by this novel window cornice and method, a preferred embodiment being shown with reference to the accompanying drawings, by way of example only, wherein:

BRIEF DESCRIPTION OF THE DRAWINGS

FIG. 1 is a perspective view of the window cornice-curtain assembly;

FIG. 2 is a partial segmented side elevational view of the window cornice-curtain assembly of FIG. 1;

FIG. 3 is a partial perspective view of an end of a section of a curtain rod and a bracket;

FIG. 4 is a perspective view of the window cornice without the fabric;

FIG. 5 is a vertical sectional view taken in direction of the arrows and along the plane of line 5—5 in FIG. 4;

FIG. 6 is a perspective view of a side plate member;

FIG. 7 is a perspective view of a hollow cylindrical fabric;

FIG. 8 is a partial perspective view of the fabric of FIG. 7 disclosing the seam within the fabric;

FIG. 9 is a vertical sectional view taken in direction of the arrows and along the plane of line 9—9 in FIG. 5;

FIG. 10 is a partial side elevational view of one section of a curtain rod mating with and slidably passing into another section of the curtain rod;

FIG. 11 is a perspective view of the front plate member;

FIG. 12 is a front plan view of the three curtain rods that are employed with the window cornice-curtain assembly of this invention;

FIG. 13 is a partial perspective view of a hollow end of a section of a curtain rod;

FIG. 14 is a perspective view of the hollow cylindrical fabric passing over an end of a pair of curtain rods having secured thereto the front plate member and the pair of side plate members; and FIG. 15 is a partial vertical sectional view taken in direction of the arrows and along the plane of line 15—15 in FIG. 1.

DETAILED DESCRIPTION OF THE INVENTION

Referring in detail now to the drawings wherein similar parts of the invention are identified by like reference numerals, there is seen a window cornice-curtain assembly (see FIG. 1), generally illustrated as 10, comprising a window cornice, generally illustrated as 12, and a curtain assembly, generally illustrated as 14.

The window cornice 12 comprises an arcuate or semi-circular front plate 16 formed with an upper edge means 18 having an upper channel 20, and a lower edge means 22 having a lower channel 24. As best shown in FIG. 5, the front plate 16 is generally semi-circular in vertical cross-section. An upper curtain rod 26 is slidably disposed through the upper channel 20 and a lower curtain rod 28 is slidably disposed through the lower channel 24.

As best shown in FIG. 4, upper curtain rod 26 and lower curtain rod 28 respectively have off-set sides 26*s*—26*s* bound to an intermediate rod section 26*i*, and off-set sides 28*s*—28*s* bound to an intermediate rod section 28*i*.

As further best shown in FIG. 4, the intermediate rod section 26*i* of the upper curtain rod 26 slidably secures to the upper edge means 18 of the semi-circular front plate 16 such that the intermediate rod section 26*i* extends along the upper edge means 18 and along the length of the front plate 16 to longitudinally traverse the front plate 16. Similarly, the intermediate rod section 28*i* of the lower curtain rod 28 slidably secures to the lower edge means 22 of the semi-circular front plate 16 such that the intermediate rod section 28*i* extends along the lower edge means 22 and along the length of the front plate 16 to longitudinally traverse the front plate 16.

The curtain rods 26 and 28 respectively mount to a wall 30, and are conventional curtain rods typically comprising a pair of sections. More specifically and by way of exmaple only in referring to FIG. 10, upper curtain rod 26 comprises sections 32 and 34, with section 32 slidably disposed in section 34. Similarly, lower curtain rod 28 typically comprises a section 36 slidably disposed in a section 38. Each of the sections 32, 34, 36 and 38 have an open end with a lower aperture in close proximity to the open end such that the sections can engage a bracket. Referring to FIG. 3 by way of example only for more specificity, section 32 terminates in a hollow end 40 having a lower aperture 42 in close proximity thereto for mounting to a bracket 44 attached to the wall 30 by bolts 46–46. The bracket 44 includes an ear 48 protruding therefrom and having a lug 50 extending from the lower part thereof. The ear 48 slidably passes into the hollow end 40 such that lug 50 is removably disposed in lower aperture 42. The other sections 34, 36 and 38 are similarly formed such that each may mount to a bracket 44 mounted or attached on the wall 30 in order to hold the semi-circular plate 16 in a general horizontal (or other desired) position.

The window cornice 12 may additionally comprise a pair of arcuate or semi-circular side plates 52—52 respectively mounted to the rods 26 and 28 in an opposed relationship as shown in FIG. 4. Each side plate 52 is formed with an upper edge means 54 and a lower edge means 56. The upper edge means 54 and the lower edge means 56 include an upper side channel 58 and a lower side channel 61 respectively (see FIG. 6). Channel 58 slidably receives section 32 or 34 of the rod means 26 and channel 61 slidably receives section 36 or 38 of the rod means 28. As best shown in FIG. 4, the semi-circular side plates 52—52 more particularly mount to the off-set sides 26*s*—26*s* and 28*s*—28*s* of the rods 26 and 28, respectively.

The window cornice 12 additionally includes a fabric 60 formed with a seam 62 and into a hollow cylindrical configuration, as illustrated in FIG. 7. The fabric 60 defines the outside or exterior of the window cornice 12. As illustrated in FIGS. 14 and 15, the combinations of the pair of side plates 52—52, the front plate 16, and the pair of curtain rod means 26 and 28 are surrounded by the fabric 60 by sliding the combinations through the hollow, cylindrical fabric 60. The ends of sections 32, 34, 36 and 38 are left exposed, protruding from the open ends of the cylindrical fabric 60 in order to respectively connect to four brackets 44 which have been secured to desired locations on the wall 30. A third curtain rod means 62 (see FIG. 12) is mounted to the wall member 30 in between rod means 26 and 28, as further illustrated in FIG. 4. A curtain 64 may be hung from this third curtain rod means 62 to obtain the window cornice-curtain assembly 10.

With continuing reference to the drawings for the method for hanging curtains employing the window cornice 12, the front plate 16 and the pair of side plates 52—52 are all initially formed in accordance with the previously mentioned shapes and features. Section 32 of curtain rod means 26 is slid through the upper channel 58 of one of the side plates 52 and into the upper channel 20 of the front plate 16. Section 34 of curtain rod means 26 is subsequently slid through the upper channel 58 of the other side plate 52 and into the upper channel 20 of the front plate 16. Sections 32 and 34 are continually slid while in upper channels 58 and 58 of the two side plates 52—52 respectively and while in the upper channel 20 of the front plate 16 until the section 32 slides into the section 34 (see FIG. 9). Similarly, section 36 of curtain rod means 28 is slid through the lower channel 61 of the side plate 52 having section 32 in its upper channel 58, and into the lower channel 24 of the front plate 16. Section 38 of rod means 28 is subsequently slid through the lower channel 61 of side plate 52 having section 34 in its upper channel 58, and into the lower channel 24 of the front plate 16. Sections 36 and 38 are continually slid while in the lower channels 61 and 61 of side plates 52—52 respectively and while in the lower channel 24 of the front plate 16 until section 36 slides into section 38 (see FIG. 9). Thereafter, fabric 60 is formed into the hollow cylindrical shape of FIG. 7, and as illustrated in FIG. 14, the formed hollow cylindrical fabric 60 is slid over one of the side plates 52, the front plate 16, and the other side plate 52 such as to entirely surround all of the same including the respective sections of the curtain rod means 26 and 28 in the upper and lower channels respectively of the front plate 16 and the pair of side plates 52—52. The hollow ends 40 of sections 32, 34, 36 and 38 are exposed in order to engage four brackets 44—44—44—44 which have been disposed as desired on the wall 30. The third curtain rod means 62 may now be mounted to a pair of brackets 44—44 that have been respectively positioned between the two pairs of outside brackets 44—44 and 44—44 such that rod means 62 is in between the rod means 26 and 28. The curtain 64 can now be hung from the third curtain rod means 62 to produce the window cornice-curtain assembly 10 of FIG. 1. It is to be understood as would be readily apparent that the third curtain rod means 62-curtain 64 combination can be secured to wall 30 initially, followed by the mounting of the window cornice 12 such as to cover the top of the curtain 64 including the third curtain rod means 62.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A window cornice assembly comprising a front plate member semi-circular in vertical cross-section and having an upper edge and a lower edge; a rod including an intermediate rod section that is slidably secured to said upper edge of said front plate member such that the intermediate rod section extends longitudinally along the upper edge of the front plate member, said rod having at least one off-set side bound to said intermediate section and with an end being adaptable to mount to a wall member; and at least one side plate member slidably secured to said at least one off-set side of said rod.

2. The window cornice assembly of claim 1 wherein said rod having at least one off-set side comprises a first off-set side and a second off-set side with ends being adaptable to mount to a wall member.

3. The window cornice assembly of claim 2 wherein said at least one side plate member slidably secured to said at least one off-set side of said rod comprises a first side plate member having a first upper edge and a first lower edge with said first upper edge slidably secured to said first off-set side of said rod; and a second side plate member having a second upper edge and a second lower edge with said second upper edge slidably secured to said second off-set side of said rod.

4. The window cornice assembly of claim 1 additionally comprising a fabric means disposed around said front plate to surround said same.

5. The window cornice assembly of claim 4 wherein said fabric means is additionally disposed around said at least one side plate.

6. The window cornice assembly of claim 3 additionally comprising a fabric means disposed around said front plate and around said first side plate and around said second side plate to surround all of said same.

7. The window cornice assembly of claim 4 wherein said fabric means is disposed around said front plate such as to entirely surround said front plate including the intermediate rod section of the rod that is slidably secured to said upper edge of said front plate.

8. The window cornice assembly of claim 5 wherein said fabric means is additionally disposed around said at least one side plate such as to entirely surround said at least one side plate including the at least one off-set side of said rod that is slidably secured to said at least one side plate.

9. The window cornice assembly of claim 6 wherein said fabric means is disposed around said front plate and around said first side plate and around said second side plate such as to entirely surround said front plate and said first side plate and said second side plate including the intermediate rod section of the rod that is slidably secured to said upper edge of said front plate and said first off-set side of said rod that is slidably secured to said first upper edge of said first side plate and said second off-set side of said rod that is slidably secured to said second upper edge of said second side plate.

10. The window cornice assembly of claim 1 wherein said rod a curtain rod.

11. The window cornice assembly of claim 4 wherein said rod a curtain rod.

12. The window cornice assembly of claim 6 wherein said rod a curtain rod.

13. A window cornice assembly comprising a front plate member semi-circular in vertical cross-section and having an upper edge and a lower edge; a rod including an intermediate rod section that is slidably secured to said lower edge of said front plate member such that the intermediate rod section extends longitudinally along the lower edge of the front plate member, said rod having at least one off-set side bound to said intermediate section and with an end being adaptable to mount to a wall member; and at least one side plate member slidably secured to said at least one off-set side of said rod.

14. The window cornice assembly of claim 13 wherein said rod having at least one off-set side comprises a first off-set side and a second off-set side with ends being adaptable to mount to a wall member.

15. The window cornice assembly of claim 14 wherein said at least one side plate member slidably secured to said at least one off-set side of said rod comprises a first side plate member having a first upper edge and a first lower edge with said first lower edge slidably secured to said first off-set side of said rod; and a second side plate member having a second upper edge and a second lower edge with said second lower edge slidably secured to said second off-set side of said rod.

16. The window cornice assembly of claim 13 additionally comprising a fabric means disposed around said front plate to surround said same.

17. The window cornice assembly of claim 16 wherein said fabric means is additionally disposed around said at least one side plate.

18. The window cornice assembly of claim 15 additionally comprising a fabric means disposed around said front plate and around said first side plate and around said second side plate.

19. The window cornice assembly of claim 16 wherein said fabric means is disposed around said front plate such as to entirely surround said front plate including the intermediate rod section of the rod that is slidably secured to said lower edge of said front plate.

20. The window cornice assembly of claim 17 wherein said fabric means is additionally disposed around said at least one side plate such as to entirely surround said at least one side plate including the at least one off-set side of said rod that is slidably secured to said at least one side plate.

21. The window cornice assembly of claim 18 wherein said fabric means is disposed around said front plate and around said first side plate and around said second side plate such as to entirely surround said front plate and said first side plate and said second side plate including the intermediate rod section of the rod that is slidably secured to said lower edge of said front plate and said first off-set side of said rod that is slidably secured to said first lower edge of said first side plate and said second off-set side of said rod that is slidably secured to said second lower edge of said second side plate.

22. The window cornice assembly of claim 13 wherein said rod a curtain rod.

23. The window cornice assembly of claim 16 wherein said rod is a curtain rod.

24. The window cornice assembly of claim 18 wherein said rod is a curtain rod.

25. A window cornice assembly comprising a front plate member having an upper edge and a lower edge, said front plate member being a semi-circular plate in vertical cross-section; an upper rod slidably secured to said upper edge; and a lower rod slidably secured to said lower edge, said upper and lower rods having off-set sides with ends being adaptable to mount to a wall member; and a fabric means disposed around said front plate such as to entirely surround said front plate including the sections of the upper and lower rods that are slidably secured to said upper and lower edges and said offset sides.

26. The window cornice of claim 25 additionally comprising a first side plate member having a first upper edge and a first lower edge, said lower rod is slidably secured to said first lower edge and said upper rod is slidably secured to said first upper edge.

27. The window cornice of claim 26 additionally comprising a second side plate member having a second upper edge and a second lower edge, said lower rod is slidably secured to said second lower edge and said upper rod is slidably secured to said second upper edge.

28. The window cornice assembly of claim 25 wherein said upper rod is a curtain rod and said lower rod is a curtain rod.

29. The window cornice assembly of claim 27 where said upper rod is a curtain rod and said lower rod is a curtain rod.

30. A window cornice assembly comprising a front plate member semi-circular in vertical cross-section and having an upper edge and a lower edge; a rod having an intermediate rod section that is secured to said upper edge of said front plate member such that the intermediate rod section extends longitudinally along the upper edge of the front plate member and comprising a first off-set side and a second off-set side both bound to said intermediate rod section with said first off-set side and said second off-set side including ends being adaptable to mount to a wall member; a first side plate member secured against said first off-set side; and a second side plate member secured against said second off-set side.

31. The window cornice assembly of claim 30 wherein said first side plate is a semi-circular first side plate.

32. The window cornice assembly of claim 30 wherein said second side plate is a semi-circular second side plate.

33. The window cornice assembly of claim 30 additionally comprising a fabric member disposed over the front plate member and supported thereby.

34. The window cornice assembly of claim 33 wherein said fabric member is additionally disposed over said first side plate member and said second side plate member.

35. The window cornice assembly of claim 30 wherein said rod is a curtain rod.

36. The window cornice assembly of claim 34 wherein said rod is a curtain rod.

37. A window cornice assembly comprising a front plate member semi-circular in vertical cross-section and having an upper edge and a lower edge; a rod having an intermediate rod section that is secured to said lower edge of said front plate member such that the intermediate rod section extends longitudinally along the lower edge of the front plate member and comprising a first off-set side and a second off-set side both bound to said intermediate rod section with said first off-set side and said second off-set side including ends being adaptable to mount to a wall member; a first side plate member secured against said first off-set side; and a second side plate member secured against said second off-set side.

38. The window cornice assembly of claim 37 wherein said first side plate is a semi-circular first side plate.

39. The window cornice assembly of claim 37 wherein said second side plate is a semi-circular second side plate.

40. The window cornice assembly of claim 37 additionally comprising a fabric member disposed over the front plate member and supported thereby.

41. The window cornice assembly of claim 40 wherein said fabric member is additionally disposed over said first side plate member and said second side plate member.

42. The window cornice assembly of claim 37 wherein said rod is a curtain rod.

43. The window cornice assembly of claim 41 wherein said rod is a curtain rod.

44. A window cornice assembly comprising a front plate member semi-circular in vertical cross-section and having an upper edge and a lower edge; a rod having an intermediate rod section that is secured to said front plate member such that the intermediate rod section extends longitudinally along the front plate member and comprising a first off-set side and a second off-set side both bound to said intermediate rod section with said first off-set side and said second off-set side including ends being adaptable to mount to a wall member; a semi-circular first side plate member secured against said first off-set side; and a semi-circular second side plate member secured against said second off-set side.

45. The window cornice assembly of claim 44 additionally comprising a fabric member disposed over the front plate member and supported thereby.

46. The window cornice assembly of claim 45 wherein said fabric member is additionally disposed over said semi-circular first side plate member and said semi-circular second side plate member.

47. The window cornice assembly of claim 44 wherein said rod is a curtain rod.

48. The window cornice assembly of claim 46 wherein said rod is a curtain rod.

49. A window cornice assembly comprising a front plate member having an upper edge defining an upper channel and a lower edge defining a lower channel; an upper curtain rod means slidably disposed through said upper channel for supporting the front plate member; and a lower curtain rod means slidably disposed through said lower channel for supporting the front plate member; said upper curtain rod means having upper off-set sides with ends being adaptable to mount to a wall member and said lower curtain rod means having lower off-set sides with ends being adaptable to mount to a wall member; and a first side plate member having a first upper edge defining a first upper channel and a first lower edge defining a first lower channel, said upper curtain rod means is slidably disposed through said first upper channel of said first side plate, and said lower curtain rod means is slidably disposed through said first lower channel of said first side plate.

50. The window cornice assembly of claim 49 additionally comprising a second side plate member having a second upper edge defining a second upper channel and a second lower edge defining a second lower channel, said upper curtain rod means is slidably disposed through said second upper channel and said lower curtain rod means is slidably disposed through said second lower channel.

51. The window cornice assembly of claim 50 additionally comprising a fabric means disposed around said front plate for surrounding said front plate.

52. The window cornice assembly of claim 51 wherein said front plate member is semi-circular in vertical cross-section.

53. The window cornice assembly of claim 52 wherein said first side plate member is a semi-circular first side plate.

54. The window cornice assembly of claim 52 wherein said second side plate member is a semi-circular second side plate.

55. A window cornice assembly comprising a rod having an intermediate rod section and at least one off-set side bound to said intermediate section and with an end being adaptable to mount to a wall member; at least one semi-circular side member secured against said at least one off-set side of said rod; and a fabric member disposed over the at least one semi-circular side member and supported thereby.

56. The window cornice assembly of claim 55 wherein said rod having at least one off-set side comprises a first off-set side and a second off-set side with ends being adaptable to mount to a wall member.

57. The window cornice assembly of claim 56 wherein said at least one semi-circular side member secured against said at least one off-set side of said rod comprises a first semi-circular side member having a first upper edge and a first lower edge with said first upper edge secured against said first off-set side of said rod; and a second semi-circular side member having a second upper edge and a second lower edge with said second upper edge secured against said second off-set side of said rod.

58. The window cornice assembly of claim 56 wherein said at least one semi-circular side plate member secured against said at least one off-set side of said rod comprises a first semi-circular side plate member having a first upper edge and a first lower edge with said first lower edge secured against said first off-set side of said rod; and a second semi-circular side plate member having a second upper edge and a second lower edge with said second lower edge secured against said second off-set side of said rod.

59. The window cornice assembly of claim 56 wherein said rod is a curtain rod.

* * * * *

UNITED STATES PATENT AND TRADEMARK OFFICE

CERTIFICATE OF CORRECTION

PATENT NO. : 4,966,218

DATED : October 30, 1990

INVENTOR(S) : Margaret A. Peters

It is certified that error appears in the above-identified patent and that said Letters Patent is hereby corrected as shown below:

In the Title and Abstract page: under "Other Publications", line 3, delete "Plumberg," and substitute ---Plumbing---.

Column 6, line 26, after "rod" (first occurrence) insert --- is ---.

Column 6, line 28, after "rod" (first occurrence) insert --- is ---.

Column 6, line 30, after "rod" (first occurrence) insert --- is ---.

Column 7, line 23, after "rod" (first occurrence) insert --- is ---.

Signed and Sealed this

Twenty-fifth Day of February, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,966,218
DATED : October 30, 1990
INVENTOR(S) : Margaret A. Peters It is certified that error appears in the above-identified patent and that said Letters Patent is hereby corrected as shown below:

Column 10, line 33:
Claim 58, line 2, delete "plate".
Column 10, line 35:
Claim 58, line 4, delete "plate".
Column 10, line 38:
Claim 58, line 7, delete "plate".

Signed and Sealed this

Twentieth Day of October, 1992

*Attest:*

DOUGLAS B. COMER

*Attesting Officer*

*Acting Commissioner of Patents and Trademarks*